US008814521B2

(12) United States Patent
Hoyland et al.

(10) Patent No.: US 8,814,521 B2
(45) Date of Patent: Aug. 26, 2014

(54) ANNULUS FILLER FOR A GAS TURBINE ENGINE

(75) Inventors: Matthew A. C. Hoyland, Chesterfield (GB); Paul Mason, Derby (GB)

(73) Assignee: Rolls-Royce PLC, London (GB)

( * ) Notice: Subject to any disclaimer, the term of this patent is extended or adjusted under 35 U.S.C. 154(b) by 935 days.

(21) Appl. No.: 12/899,799

(22) Filed: Oct. 7, 2010

(65) Prior Publication Data

US 2011/0110780 A1 May 12, 2011

(30) Foreign Application Priority Data

Nov. 11, 2009 (GB) ..... 0919657.7
Mar. 2, 2010 (GB) ..... 1003442.9

(51) Int. Cl.
*F01D 11/00* (2006.01)

(52) U.S. Cl.
CPC ..... *F01D 11/008* (2013.01); *F05D 2220/36* (2013.01)
USPC ..... 416/193 R

(58) Field of Classification Search
USPC ..... 416/189, 193 R, 194, 196 R, 500, 244 A, 416/214 A, 204 A
See application file for complete search history.

(56) References Cited

U.S. PATENT DOCUMENTS 5,466,125 A * 11/1995 Knott ..... 416/193 A
2009/0208335 A1* 8/2009 Bottome ..... 416/179

FOREIGN PATENT DOCUMENTS

EP 1 013 886 A2 6/2000
EP 2 090 749 A2 8/2009
EP 2 098 689 A2 9/2009
WO WO 93/21425 A1 10/1993

OTHER PUBLICATIONS

British Search Report dated Apr. 14, 2010 in corresponding British Patent Application No. 0919657.7.

* cited by examiner

*Primary Examiner* — Edward Look
*Assistant Examiner* — Adam W Brown
(74) *Attorney, Agent, or Firm* — Oliff PLC

(57) ABSTRACT

An annulus filler for mounting to a rotor disc of a gas turbine engine. The filler comprises a lid for bridging the gap between two adjacent blades attached to the rotor disc, and forward and rearward hook members projecting below the lid and configured to respectively engage with forward and rearward outwardly directed hooks provided on the rotor disc. The filler can further comprise a lip extending from the rear of the lid, the lip being configured to fit beneath a gas-washed element located rearwards of the annulus filler. One or more guide ramps then extend from the rear of the lip, the or each guide ramp being angled down relative to the lip to encourage the lip to slide beneath said fairing when the annulus filler is translated in the generally rearwards direction.

6 Claims, 3 Drawing Sheets

ANNULUS FILLER FOR A GAS TURBINE ENGINE

The present invention relates to annulus fillers for bridging gaps between adjacent blades of a gas turbine engine stage.

Conventionally, the fan stage of a gas turbine engine comprises a plurality of radially extending fan blades mounted on a rotor or fan disc. The blades are mounted on the disc by inserting a root portion of the blade in a complementary retention groove in the outer face of the disc periphery. To ensure a smooth radially inner surface for air to flow over as it passes through the stage, annulus fillers are used to bridge the spaces between adjacent blades. Typically, seals between the annulus fillers and the adjacent fan blades are also provided by resilient strips bonded to the annulus fillers adjacent the fan blades.

The fillers may be manufactured from relatively lightweight materials and, in the event of damage, may be replaced independently of the blades.

It is known to provide annulus fillers with features for removably attaching them to the rotor disc. For example, annulus fillers can be provided with axially spaced hook members, the hook members sliding into engagement with respective parts of the rotor disc. FIG. 1 shows an example of such an annulus filler viewed from the side, and FIG. 2 shows the annulus filler fitted to the rotor disc as viewed in transverse cross-section.

In use, the upper surface or lid 2 of the annulus filler 1 bridges the gap between two adjacent fan blades 3 (one of which is shown in outline in FIG. 2) and defines the inner wall of the flow annulus of a fan stage. The annulus filler 1 is mounted on a fan disc 4 by two hook members 5, 6 respectively towards the forward and rearward ends of the annulus filler 1. The hook members are configured to engage with outwardly directed hooks provided on the fan disc 4. The annulus filler is also attached to a support ring 7 by a retention flange 8 provided at the forward end of the annulus filler. Along its rear edge, the annulus filler is provided with a rear lip 9 which is configured to fit under a rear fan seal 10 located axially behind the rotor disc 4 to limit deflection under running conditions. Similarly, the front edge of the annulus filler defines a front lip 11 which is configured to fit under a spinner fairing 12 or nose cone located axially ahead of the annulus filler. The two opposed side faces 13, 14 of the annulus filler are provided with respective seal strips (not shown) and confront the aerofoil surfaces of the adjacent fan blades 3 in a sealing manner.

The retention flange 8 carries a forwardly extending spigot or pin 15. The spigot or pin 15 is arranged for engagement within a corresponding aperture or recess provided in the support ring 7. At a position circumferentially adjacent the spigot or pin 15, the retention flange can also be provided with a mounting aperture (not shown) which is arranged for co-alignment with a corresponding mounting aperture (not shown) provided through the support ring 7. The co-aligned mounting apertures are sized to receive a mounting bolt. Thus, it will be appreciated that the retention flange 8 is pinned and optionally bolted to the front support ring 7.

The hook members 5, 6 define respective arcuate channels 16, 17. The channels are curved in such a manner as to be centred on the rotational axis of the engine (not shown), and cooperate with a correspondingly arcuate hooks 18, 19 on the rotor disc 4.

A problem which has been experienced with prior art annulus fillers of the general type described above is that of reliable installation during engine assembly. As will be appreciated, the annulus filler must be fitted after the radially extending fan blades have been attached to the rotor disc. This means when the fitter then comes to install the annulus fillers between adjacent blades, his or her line of sight is obstructed by the presence of the fan blades. Also, the filler lid 2 obstructs the fitter's view when attempting to engage the hook members 5, 6 with the rotor disc 4. Misassembly of the rear hook member 6 and/or the rear lip 9 has been found to be a particular problem in this regard and has been attributed to the release of annulus fillers in operation.

Accordingly, a first aspect of the present invention provides an annulus filler for mounting to a rotor disc of a gas turbine engine, the annulus filler comprising:

a lid for bridging the gap between two adjacent blades attached to the rotor disc, forward and rearward hook members projecting below the lid and configured to respectively engage with forward and rearward outwardly directed hooks provided on the rotor disc when the annulus filler is translated in a generally rearwards direction on mounting of the annulus filler to the rotor disc, and a lip extending from the rear of the lid, the lip being configured to fit beneath a gas-washed element (such as a rear fan seal) located rearwards of the annulus filler; wherein the annulus filler further comprises one or more guide ramps which extend from the rear of the lip, the or each guide ramp being angled down relative to the lip to encourage the lip to slide beneath said gas-washed element when the annulus filler is translated in said generally rearwards direction.

By providing the one or more guide ramps, a misassembly problem in which the rear lip slides over the gas-washed element can be avoided.

The forward hook member may have a stop surface which, on engaging the forward hook member to the forward outwardly directed hook, can abut a surface of the rotor disc to prevent or reduce rotation of the annulus filler about the forward hook member, whereby the forward hook member can only engage with the forward outwardly directed hook when the rearward hook member also engages with the rearward outwardly directed hook.

By providing the abutment surface, a further misassembly problem in which the rear hook member does not engage with the rearward outwardly directed hook, but rather rides up above it, can be avoided.

Indeed, there may be provided an annulus filler for mounting to a rotor disc of a gas turbine engine, the annulus filler comprising: a lid for bridging the gap between two adjacent blades attached to the rotor disc, and forward and rearward hook members projecting below the lid and configured to respectively engage with forward and rearward outwardly directed hooks provided on the rotor disc when the annulus filler is translated in a generally rearwards direction on mounting of the annulus filler to the rotor disc; wherein the forward hook member has a stop surface which, on engaging the forward hook member to the forward outwardly directed hook, can abut a surface of the rotor disc to prevent or reduce rotation of the annulus filler about the forward hook member, whereby the forward hook member can only engage with the forward outwardly directed hook when the rearward hook member also engages with the rearward outwardly directed hook.

The annulus filler may have any one or, to the extent that they are compatible, any combination of the following optional features.

When the annulus filler has a stop surface, this may conveniently be provided by a protuberance on a front-facing side of the forward hook member.

Preferably the lid has a stiffening rib on the underside thereof, the rib extending between the forward and rearward hook members. The stiffening rib can help to prevent deflections of the lid between the forward and rearward hook members. Particularly in combination with the abutment surface, the rib can help the forward hook member to only engage with the forward outwardly directed hook when the rearward hook member also engages with the rearward outwardly directed hook.

Preferably the annulus filler further comprises a lip extending from the front of the lid, the front lip being configured to fit beneath a gas-washed element (such as a spinner fairing or nose cone) located forwards of the annulus filler.

Embodiments of the invention will now be described by way of example with reference to the accompanying drawings in which.

Figure 1:
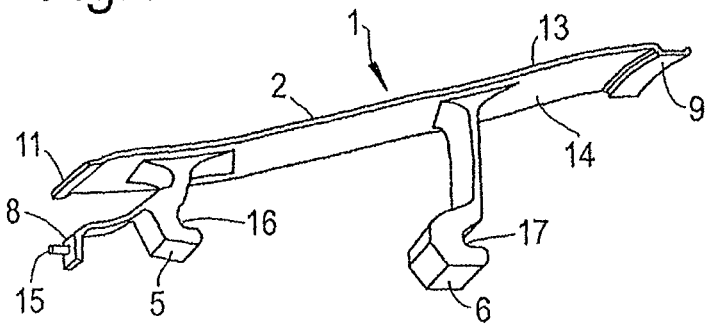
FIG. 1 shows a conventional annulus filler viewed from the side.
Figure 2:
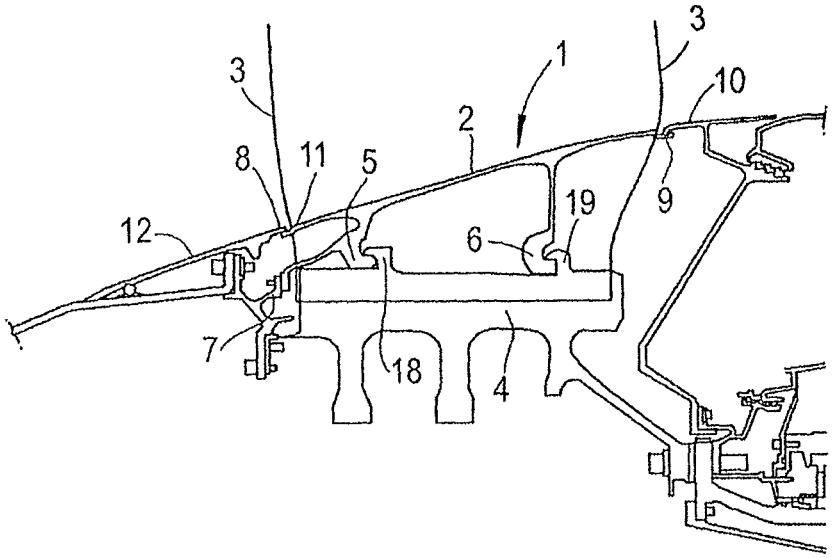
FIG. 2 shows the annulus filler of FIG. 1 viewed in transverse cross-section and fitted to a rotor disc.

The conventional annulus filler shown in FIGS. 1 and 2 can be misassembled with the rotor. This can lead to the release of the filler and an aborted take-off. The released filler can also cause significant damage to the fan case and/or fan liners.

Figure 3:
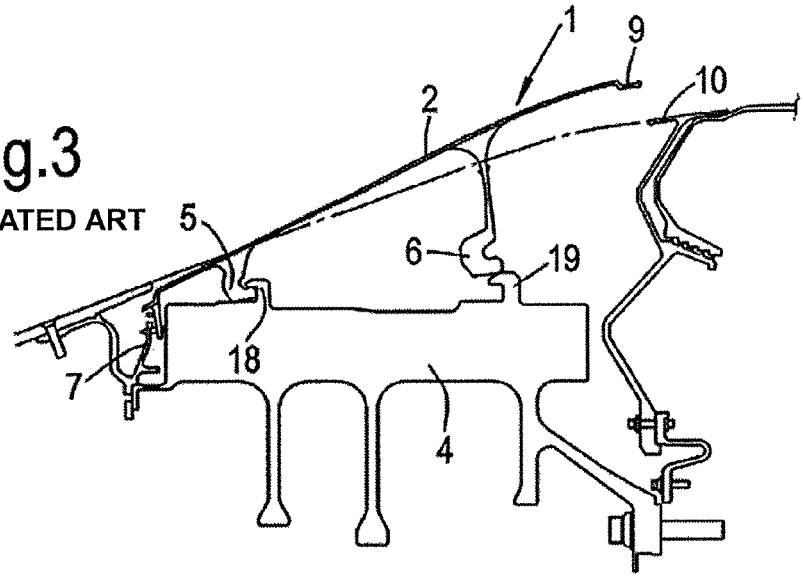
Fig.3 RELATED ART
FIG. 3, shows a transverse cross-section of an annulus filler incorrectly fitted to a rotor disc.

In more detail, as the installer's view of the hook members 5, 6 is blocked by the lid 2 and the blades during assembly, the rear hook member 6 can end up installed above the rearward outwardly directed hook 19 on the rotor, even if the forward hook member 5 is engaged with the forward outwardly directed hook 18. This situation is illustrated in FIG. 3, which is a transverse cross-section of an annulus filler 1 incorrectly fitted to a rotor disc. The flexibility of the forward end of the filler and of the support ring 7 allow the support ring to be installed, giving the appearance of a correctly fitted filler. However, without the engagement of the rear hook member, the filler will be released when the engine is started.

Additionally, or separately, due to deflections at the rear end of the filler 1, and abetted by the blind assembly, the rear lip 9 of the filler can ride above the rear fan seal 10 during filler installation. When misinstalled in this way, because the rear end of the filler is unrestrained, the high centrifugal loads experienced by the filler can cause large deflections and ultimately lead to filler failure.

Figure 4A:
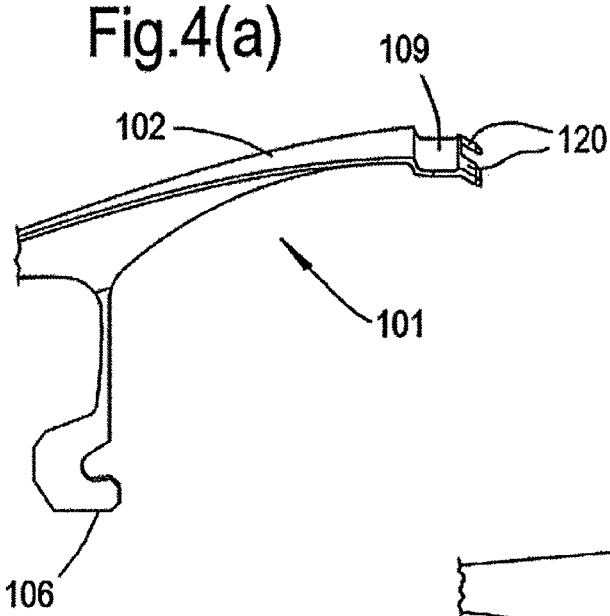
FIG. 4 shows (a) a side view of the rear end and (b) a perspective view of the rear end of an annulus filler according to an embodiment of the present invention.
Figure 4B:
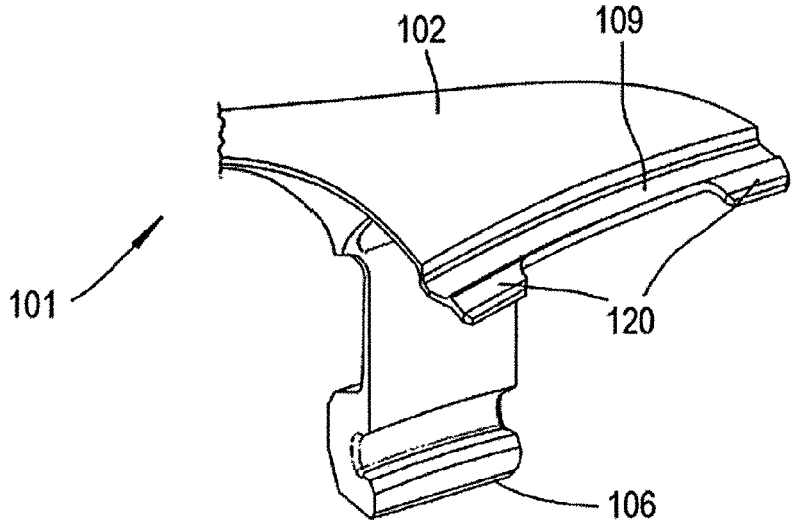
Figure 5:
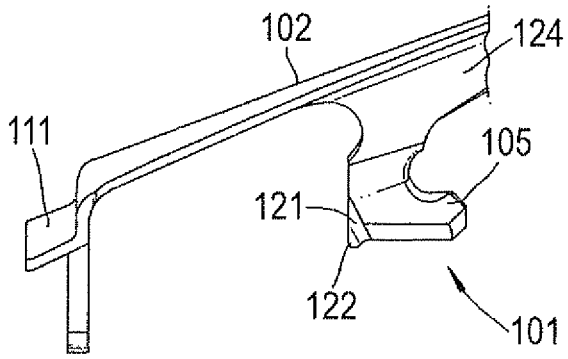
FIG. 5 shows (a) a side view of the front end and (b) a perspective view of the underside of the front end of the annulus filler of FIG. 4.
Figure 5B:
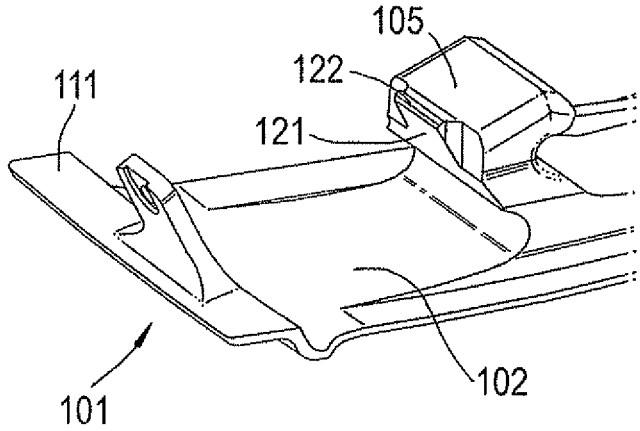
Figure 6:
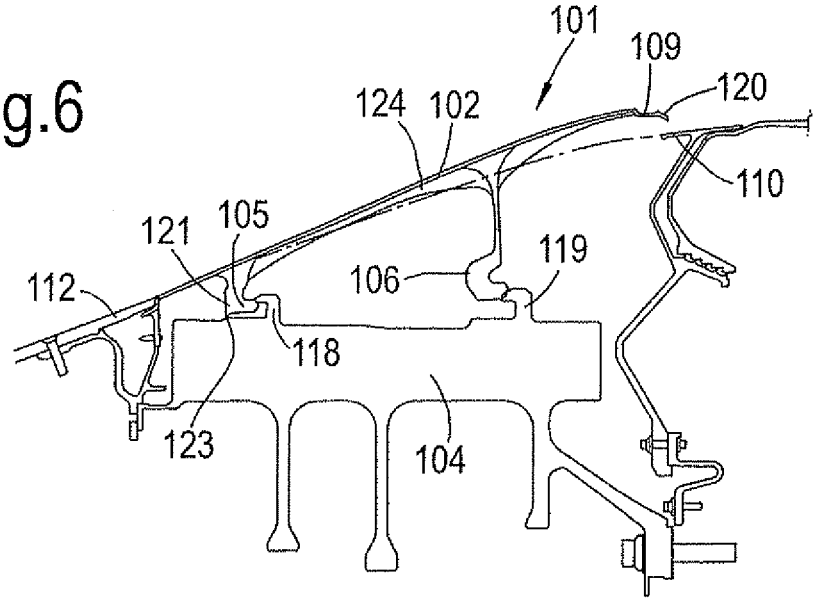
FIG. 6 shows a transverse cross-section of the annulus filler of FIG. 4 in an attempt to incorrectly fit the filler to a rotor disc.

FIG. 4 shows (a) a side view of the rear end and (b) a perspective view of the rear end of an annulus filler 101 according to an embodiment of the present invention, FIG. 5 shows (a) a side view of the front end and (b) a perspective view of the underside of the front end of the annulus filler, and FIG. 6 shows a transverse cross-section of the annulus filler in an attempt to incorrectly fit the filler to a rotor disc.

The filler 101 has a lid 102 which bridges the gap between two adjacent fan blades (not shown) attached to rotor disc 104. Forward 105 and rearward 106 hook members extend down from the underside of the lid. On installation of the filler, the hook members engage with corresponding forward 118 and rearward 119 hooks extending outwardly from rotor disc 104. Front 111 and rear 109 lips respectively extend from the front and rear edges of the lid. On installation of the filler, the front lip fits under a nose cone 112 located forward of the annulus filler and the rear lip fits under a rear fan seal 110 located rearward of the annulus filler. The positions and purposes of the hook members and lips are thus similar to those of the corresponding features of the conventional filler shown in FIGS. 1 and 2.

However, as shown best in FIGS. 4(*a*) and (*b*), to avoid incorrect positioning of the rear lip 109 relative to the rear fan seal 110, two spaced guide ramps 120 extend downwardly at an angle from the rear edge of the rear lip. The angle of the ramps encourages the rear lip to slide under the rear fan seal when the filler 101 is translated in a generally rearwards direction on mounting of the filler to the rotor disc 104. In this way, the problem of the rear lip riding above the rear fan seal can be avoided, even on blind assembly. The ramps can be particularly effective on module build when the entire rotating fan module (i.e. disc, fan blades and annulus fillers) is assembled to the fan shaft and rear fan seal. The relatively short lengths of the ramps relative to the length of the rear lip helps to reduce the additional weight of the ramps. A further advantage of the guide ramps is that they provide additional length to the rear lip. During surge the fan rear seal can translate axially forwards and rearwards, creating potential for it to become disengaged from the filler. The extra length provided by the guide ramps reduces the likelihood of such disengagement.

Additionally, as shown best in FIGS. 5(*a*) and (*b*), to avoid the rearward hook member 106 not engaging with the rearward outwardly directed hook 119, a tab or protuberance 121 is provided at front-facing side of the forward hook member 105. The tab provides a stop surface 122 which on engagement of the forward hook member to the forward outwardly directed hook 118, can abut a surface 123 of the rotor disc. As shown in FIG. 6, this abutment helps to reduce rotation of the filler about the forward hook member. Advantageously, the only very limited rotation about the forward hook member which is now possible sets up a clash between the rearward hook member and the rearward outwardly directed hook, preventing the rearward hook member riding above the rearward outwardly directed hook and also preventing the forward hook member engaging with the forward outwardly directed hook. Thus the forward hook member can only engage with the forward outwardly directed hook when there is little or no rotation and the rearward hook member also engages with the rearwardly outwardly directed hook.

A pair of spaced stiffening ribs 124 extend between the forward 105 and rearward 106 hook members on the underside of the lid 102. The ribs reduce deflection of the lid and preserve the relative positions of the forward and rearward hook members. This therefore also helps to prevent the rearward hook member riding above the rearward outwardly directed hook.

To summarise, in combination, the guide ramps 120 and the tab 121 can prevent misassembly of the filler 101 and therefore prevent filler release and associated aborted take offs.

The invention claimed is:

1. An annulus filler for mounting to a rotor disc of a gas turbine engine, the annulus filler comprising:

a lid for bridging the gap between two adjacent blades attached to the rotor disc, forward and rearward hook members projecting below the lid and configured to respectively engage with forward and rearward outwardly directed hooks provided on the rotor disc when the annulus filler is translated in a generally rearwards direction on mounting of the annulus filler to the rotor disc, and a lip extending from the rear of the lid, the lip being configured to fit beneath a gas-washed element located rearwards of the annulus filler;

wherein the annulus filler further comprises one or more guide ramps which extend from the rear of the lip, the or each guide ramp being angled down relative to the lip to encourage the lip to slide beneath said gas-washed element when the annulus filler is translated in said generally rearwards direction.

2. An annulus filler according to claim 1, wherein the forward hook member has a stop surface which, on engaging the forward hook member to the forward outwardly directed hook, can abut a surface of the rotor disc to prevent or reduce rotation of the annulus filler about the forward hook member, whereby the forward hook member can only engage with the forward outwardly directed hook when the rearward hook member also engages with the rearward outwardly directed hook.

3. An annulus filler according to claim 2, wherein the stop surface is provided by a protuberance on a front-facing side of the forward hook member.

4. An annulus filler according to claim 1, wherein the lid has a stiffening rib on the underside thereof, the rib extending between the forward and rearward hook members.

5. An annulus filler according to claim 1, further comprising a second lip extending from the front of the lid, the front lip being configured to fit beneath a gas-washed element located forwards of the annulus filler.

6. An annulus filler for mounting to a rotor disc of a gas turbine engine, the annulus filler comprising:

a lid for bridging the gap between two adjacent blades attached to the rotor disc, and forward and rearward hook members projecting below the lid and configured to respectively engage with forward and rearward outwardly directed hooks provided on the rotor disc when the annulus filler is translated in a generally rearwards direction on mounting of the annulus filler to the rotor disc;

wherein the forward hook member has a stop surface which, on engaging the forward hook member to the forward outwardly directed hook, can abut a surface of the rotor disc to prevent or reduce rotation of the annulus filler about the forward hook member, whereby the forward hook member can only engage with the forward outwardly directed hook when the rearward hook member also engages with the rearward outwardly directed hook, and wherein the stop surface is provided by a protuberance that extends from a front-facing side of the forward hook member in only the radially inward direction.

* * * * *